US006191091B1

(12) United States Patent
Raymond

(10) Patent No.: US 6,191,091 B1
(45) Date of Patent: Feb. 20, 2001

(54) BIODEGRADABLE COMPOUND FOR CLEANING, DISINFECTING, AND DESCALING WATER DISPENSERS AND METHOD OF USE THEREOF

(76) Inventor: Marcel Raymond, 8094 Charlemagne, St. Augustin, Quebec (CA), J0N 1J0

( * ) Notice: Under 35 U.S.C. 154(b), the term of this patent shall be extended for 0 days.

(21) Appl. No.: 09/032,155

(22) Filed: Feb. 27, 1998

Related U.S. Application Data

(60) Provisional application No. 60/038,581, filed on Mar. 4, 1997.

(51) Int. Cl.[7] ..... C11D 1/62; C11D 3/48

(52) U.S. Cl. ..... 510/384; 510/218; 510/234; 510/477; 510/488; 510/504

(58) Field of Search ..... 510/384, 504, 510/423, 383, 499, 234, 218, 477, 488; 422/28; 134/22.14; 514/557, 558, 560

(56) References Cited

U.S. PATENT DOCUMENTS 4,507,219 * 3/1985 Hughes ..... 252/118
4,594,184 * 6/1986 Cook et al. ..... 252/542
5,000,867 * 3/1991 Heinhuis-Walther et al. ..... 252/106

* cited by examiner

*Primary Examiner*—Yogendra Gupta
*Assistant Examiner*—Gregory W. Webb

(57) ABSTRACT

The cleaning compound for a water dispenser includes four ingredients: a) N'alkyl dimethyl Benzyl Ammonium Chloride, within the range of 0.08 to 0.1% by weight; b) citric acid, of about 20% by weight of the total solution; c) propylene glycol (food grade), about 4% by weight; and d) sodium hydroxide (food grade), in sufficient quantity to neutralize the solution to a pH range preferably between 2.6 and 4.5. During the initial clean-up steps, and contrarily to prior art cleaning methods, the cleaning method does not require complete purge of the inner water reservoir from drinking water, due to the tacky nature of the cleaning compound which can still be effective in diluted state and in a submerged environment.

13 Claims, 1 Drawing Sheet

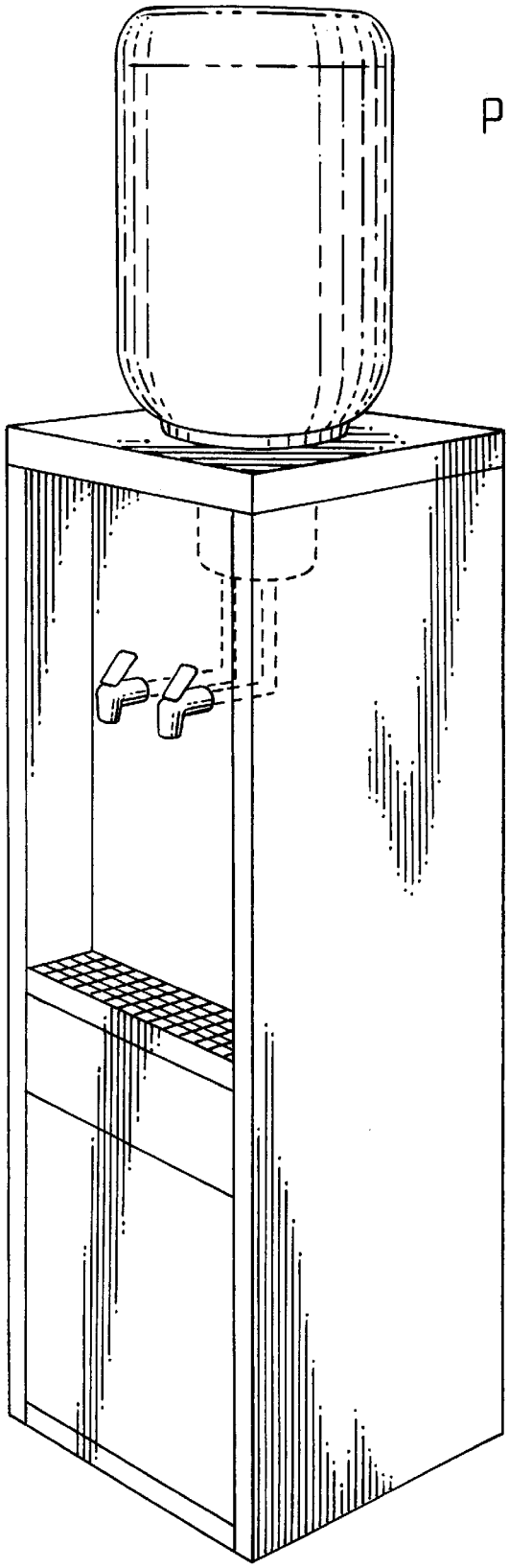
PRIOR ART

BIODEGRADABLE COMPOUND FOR CLEANING, DISINFECTING, AND DESCALING WATER DISPENSERS AND METHOD OF USE THEREOF

This application claims priority from provisional application 60/038,581 filed Mar. 4, 1997.

FIELD OF THE INVENTION

The gist of this invention is to improve upon existing cleaning compounds for fresh water dispensers, by providing a cleaning method, and associated cleaning compound which is both fully biodegradable and non toxic, being particularly effective for descaling action.

BACKGROUND OF THE INVENTION

Fresh water dispensers are nowadays common in work offices and public building of America and Europe. They are preferred by some to the municipal tap water because of health safety considerations relating to concerns as to the quality control thereof.

Indeed, an increasing number of persons are worried about pollution of underground bodies of water from uncontrolled release in the biota of dangerous chemical compounds by unscrupulous individuals. It is noted that rainwater will bias ground level dry chemicals to seep as a liquid solution through the soil, to eventually reach and contaminate the underground bodies of water—a process known as lixiviation. Lixiviation is particularly a problem in uncontrolled dumps that do not include an underlying waterproof base sheet, that would otherwise receive, support and contain solid and liquid wastes on the ground, as is currently required by municipal regulations in authorized dumps.

In these known water dispensers, a large transparent semi-flexible wall water bottle is provided in inverted condition atop the dispenser frame, to gravity-feed the water to an intermediate water reservoir inside the dispenser frame, before controlled escape through the underlying dispenser outlet nozzle. The water bottle size ranges between 1 to 20 liters, but is usually about 18 liters. Access to the water by a user is gained by manually actuating the front nozzle closed by a valve. When empty, this water bottle is removed and replace by second filled up water bottle.

Usually, the water filled inside these water bottles is pure spring water, or "filtered" water obtained usually under distillation or reverse osmosis processes.

Also, many of these fresh water dispensers have an internal refrigeration system connected to an electrical plug outlet, for maintaining the water at the temperature cooler than that of the room in which the dispenser is located, for convenience of the user.

Although the bacteria count of the so-called "pure" spring water is usually very low at the beginning, it will progressively increase due to favorable temperature and humidity levels. Moreover, contaminants in particular at the faucet outlet end, or at the spout inlet end of the water bottle, will also progressively increase the microbial count in the water conduits.

It is recognized that operating a water refrigerant system inside the dispenser apparatus will slow this contamination process, but will not prevent it, since at lower temperature settings (e.g., 10° Celsius but obviously above freezing point), the microbial activity is slowed down but not stopped.

For the maintenance of water dispensers, it is recommended by health officials to periodically (i.e. once every two months) clean the internal parts thereof with a cleaning solution that will dissolve scale and eliminate pathogenic micro-organisms, including algae, lime, mould and fungus. The goal is to maintain the bacteria count of the water in the dispenser to a negligible value. Inappropriate cleaning compounds for water cooler dispensers include:

vinegar, being a good descaler but a poor disinfectant and generating a strong after-taste smell;

sodium bicarbonate, not being a good descaler and being still less effective for disinfection;

Javel water, being a good disinfectant but very poor descaler and also undesirably corrosive for the dispenser parts and ground carpets and user's clothes, as well as generating bad after-taste to the drinking water; and hydrochloric acid or phosphoric acid, since they do damage dispenser parts, and although good descalers, they are not good disinfectants.

U.S. Pat. No. 5,454,984 issued in October 1995 to Reckitt & Colman Inc., Discloses a cleaning composition for cleaning hard surfaces and including the Combinaton of two ingredients:

a) propylene glycol (or other glycol ether compounds), as a solvent ingredient thereof, and b) alkyl dimethyl benzyl ammonium chloride, as quaternary ammonium compound component thereof, for antimicrobial activity.

U.S. Pat. No. 4,891,150 issued in January 1990 to the German Corporation Joh. A Benckiser, discloses a cleaning compound directed at a cleansing and descaling compound, including the combination of four ingredients:

a) citric acid (as part of an organic carboxylic acid);

b) a thickener compound, i.e. either alkyl alcohol ether sulfates, amphoteric or nonionic surfactants, or amine oxides;

b) a quaternary ammonium salt; and c) a deodorant perfume.

It is noted that the Benckiser patent stresses that the purpose of the thickening agent is for thickening the citric acid for enabling more thorough use thereof in sanitary cleansing applications. However, it will be recognized by those skilled in the art that this thickening of the cleaning solution for improving the descaling efficiency with citric acid, does unfortunately limit the maximum value of citric acid concentration by weight of total solution, to less than or equal to 10%. In the Benckiser patent, it is critical to thicken the descaling cleaning solution having citric acid, to obtain efficient removal of lime, scale, and rust.

U.S. Pat. No. 4,199,469 issued in 1980 to the German business concern Feldmann Chemie, discloses a compound and a method for cleaning water dispensers. The compound also has citric acid and alkyl dimethyl benzyl ammonium chloride as a quaternary ammonium, as well as an isopropyl alcohol. However, the phosphoric acid renders same non-biodegradable.

U.S. Pat. No. 5,492,629 issued in February 1996 to H E R C Products Inc., discloses a method of cleaning scale in water, including a quaternary ammonium compound having a hydrochloric acid selected in particular from the group comprising hydroxyacetic acid, citric acid, and gluconic acid.

These various above noted sanitary cleaning compound are not satisfactory in particular because they need the use of gloves being strongly corrosive or they need the use of mask because of their vapors.

They are also damageable to the environmental surfaces for example; clothes, carpets and floors. Particularly U.S. Pat. No. 4,199,469 and U.S. Pat. No. 5,492,629.

Others types of patent particularly like U.S. Pat. No. 5,454,984 will be ineffective in removing scale being simple hard surface disinfectant.

Other known cleaning compound limited to low concentration of acid like U.S. Pat. No. 4,891,150 tend to be active on the external surfaces of the dispenser parts. They are thick gel and dissolve very slowly and drop at the bottom of the inner reservoirs where they clog the entry's of conduits interfering with the cleaning process especially in aqueous systems. Also they tend not to be fully effective in seeping trough and dissolving thick scale deposits in the water conduits and inner reservoir of water dispensers particularly when the effective clean up intervals are much longer than recommended; say e.g. six months instead of the recommended intervals of two months. Moreover, these prior art cleaning solution usually need to be apply on dry surface. This will oblige that the system must first be completely purge of its water before clean-up is started and the cleaning solution can be used. They also produced high volume of foam and oblige to a long period of rinsing to eliminate the foam.; this is tedious and time consuming.

It can be readily understood even by the layman, that such cleaning process is tedious and much time-consuming. This tediousness could at least partially explain why so few water dispenser operators do in fact conform to the recommended two-months clean-up intervals. It is noted that in Canada, studies have shown that, often unbeknownst to the water dispenser operator themselves, up to a third of all water dispensers with coolers were contaminated with algae and scale concealed inside the system, due to poor maintenance. Also, one must remember that if the water dispenser is not thoroughly cleaned at each recommended interval, re-contamination of the water by the unremoved remaining microbes will rapidly occur as if no cleaning had ever happened.

OBJECTS OF THE INVENTION

An important object of this invention is to provide a sanitary cleaning compound having disinfecting, deodorizing and descaling action, which will generate a tacky film on the surfaces to be cleaned upon engagement therewith, so as to be particularly effective in dissolving deeply incrusted scale while remaining non-toxic and biodegradable.

Another important object of the invention is to provide a cleaning method for sanitary installations, particularly gravity-fed water dispensers, which will be much simpler and shorter in duration of application (typically less than ten minutes), and with a minimum number of steps than with prior art cleaning systems, while being more effective when used in cooperation with the above-noted cleaning compound.

A general object of the invention is to provide a fast-acting, biodegradable and descaling liquid compound solution that will stick, spread and wet surfaces and component parts of a water dispenser (with or without refrigeration system), with needs to be descaled, deodorized, disinfected and cleaned.

A further object of the invention is to provide in a kit the tools and liquid compound solution required for cleaning the water dispenser, as well as the directions that need to be followed for performing the cleaning operation.

An object of the cleaning compound is that it be harmless for the water dispenser parts, will not damage or bleach user's clothes fabric or ground carpets, will cause only minimal or no irritation to user's skin, eyes or mucus membranes in case of accidental contact, and will leave minimal aftertaste to the drinking water after clean-up operation is completed.

SUMMARY OF THE INVENTION

Accordingly with the objects of the invention, there is disclosed a cleansing compound for use in cleaning a water dispenser; the cleaning compound including the following four ingredients:

a) an ammonium quaternary, in particular N'alkyl dimethyl Benzyl Ammonium Chloride, and preferably within the range of 0.08 to 0.1% by weight;
b) an organic acid, (food grade), particularly a selection among citric acid, gluconic acid or hydroxy acetic acid, but most preferably citric acid, preferably within the range of 12 to 20% (most preferably about 20%);
c) propylene glycol (food grade), preferably within the range of 2 to 10% (most preferably about 4%) ; and
d) an alkaline base, preferably sodium hydroxide (food grade), in sufficient quantity to neutralize the solution to a pH range preferably between 2.6 and 4.5.

It is recognized by applicant that the four above-noted ingredients of the cleaning composition, have been disclosed separately in the four prior art patent references; but none of these cited references include all four of said ingredient at the same time. Synergistic action therebetween, in particular between the propylene glycol and the citric acid, as will be detailed hereinbelow, has not been reported in prior art documents, to applicant's knowledge.

With respect to the cleaning method for a water dispenser and using the above-noted cleaning compound, it does not require at the initial clean-up steps complete water purge of the reservoir, due to the "sticky" nature of the cleaning compound which can still be effective in a submerged environment. This cleaning method is particularly suited for—but not limited exclusively to—disinfecting and descaling a gravity-feed water dispenser with the above-noted cleansing compound. This water dispenser is of the type including a main frame having a top recess forming a water reservoir with a top open mouth, for receiving a water bottle atop in inverted position, water outlet faucets projecting outwardly from the main frame, and a water conduit network interconnecting the water reservoir to the faucets. The cleaning method of this invention includes the following steps:

a) removing the empty overhead water bottle;
b) partially emptying the water reservoir, while still leaving a small body of water at the bottom of the water reservoir, wherein the water conduit network remains submerged;
c) pour said cleaning compound onto the interior wall of the water reservoir, above water line of the remaining said body of water;
d) with a sponge, spreading the cleaning compound against the interior wall of the water reservoir and scrubbing same therealong;
e) leaving to stand the water dispenser for a period of time sufficient for the cleaning compound to reach out and penetrate the microbial and scale material;
f) open the faucets to release the body of water and cleaning compound dissolved therein;
g) unscrew the faucets and spray the cleaning compound into the water conduit network;
h) with a tubular brush, brush the water conduit network and faucets;
i) screw the faucets back in place and rinse with potable water; and
j) install a filled up fresh water bottle, preliminary disinfected on his top surface with the cleaning compound.

BRIEF DESCRIPTION OF THE DRAWINGS

The single figure of drawings shows in see-through isometric view a conventional water dispenser with overhead gravity-feed water bottle.

DETAILED DESCRIPTION OF THE EMBODIMENTS OF THE INVENTION

The liquid cleaning compound according to the present invention is characterized in that it consists of the four following ingredients:

a) an ammonium quaternary, in particular N'alkyl dimethyl Benzyl Ammonium Chloride, and preferably within the range of 0.08 to 0.1% weight;

b) an organic acid (food grade) particularly a selection among citric acid, gluconic acid or hydroxy acetic acid, but most preferably citric acid, preferably within the range of 12 to 20% (most preferably about 20%);

c) propylene glycol (food grade), preferably within the range of 2 to 10% (most preferably about 4%);

d) an alkaline base, preferably sodium hydroxide (food grade), in sufficient quantity to neutralize the solution to a pH range preferably between 2.6 and 4.5.

Unexpected results come from synergy of the four ingredients generating a compound tackiness that stems from the combination of propylene glycol with the citric acid (or to a lesser degree, with the gluconic acid or the hydroxy acetic acid), within the selected pH range. The quaternary ammonium ingredient is used for its known anti-microbial properties. It is well known that the plurality of scale recesses are perfect nesting sites for growth of bacteria colonies and other microbes.

As the tacky compound engages scale material, it adheres and attaches thereto, thus promoting extended duration contact of the scale microbial material with the quaternary ammonium alcohol elements carried therewith.

Indeed, from the time the sticky compound has adhered to the scale material incrusted on the hard wall of the water dispenser parts, in depth action of the anti-microbial quaternary ammonium can fully express Itself by seeping through thick scale deposits quickly to the hard surface of the dispenser frame component, wherein the scale is rapidly dissolved, while the microbe concealed therein are destroyed. Afterwards, the scrubbing action with the manual brushes will remove any left-over.

Prior art cleaning and descalling agents were at the most of a thickened nature (as in U.S. Pat. No. 4,891,150 to Benckiser, supra), but did not boast the advantageous and unexpected feature of the present invention tackiness of the cleaning compound when contacting scale material incrusted against the interior walls of water conduits or reservoir inside a water dispenser (with or without refrigerant system).

Although this cleaning compound is particularly suitable for water dispensers, with or without a refrigerant system, it is to be noted that it is not limited thereto. Indeed, other examples of suitable applications would be in sanitary installations in general, e.g. W.C., sinks, showers, bathtubs, swimming pools, and the like; or other installations having running or non running water. This list of possible applications is not exhaustive.

The present cleaning solution of the invention has a fast wetting, low viscosity action, with surprising tacky properties providing self-adhering capability upon contact with hard surfaces to be cleaned. This tacky adhesion enhances acid penetration into scale and lime. The disinfectant component thereof is effective within a large spectrum of microbial agents against both gram positive and gram negative bacteria, and will boost lethal action against substantially all yeast's, mold, and viruses within a short period of time (not more than two minutes for 97% lethality rate).

This solution will be harmless for dispenser parts, safe for user's hands and clothes, and will have low toxicity so as to be readily biodegradable. The solution of this invention will further not leave bad after-taste to the water after clean-up. It is important to note that the advantageous and unexpected features of the present cleaning composition, compared to prior art cleaning compositions are enabled by:

the absence of wetting agents, such as non ionic surfactants, or anionic agents, or amphoteric agent perfumes or dyes;

the absence of any strong undesirable inorganic acids, such as hydrochloric acid sulfuric acid, hydrofluoric acid, nitric acid, or phosphoric acid the absence of particular organic acids that leave bad after-tastes such as oxalic acids, formic acids, maleic acids, dicarboxylic acids (SOKOLAN DCS), acetic acids, sulfonic acids, or the like that generate foul odors or fumes.

Furthermore, contrary to prior art concepts, some of which being already patented, the present cleaning compound is not of high paste-like density, but is rather quite liquid and tacky, with a low viscosity ratio. Such a composition and tackiness ensures optimum spreading and penetrating action into the scale and lime, wherein the latter can be effectively dissolved by the citric acid.

Indeed, the citric acid with concentration of 20% as in the present compound will be made very efficient due to the continuous contacting engagement of the acid solution with all the hard surfaces of the water dispenser (or other article to be cleaned) to be descaled. This continuous contacting engagement is enabled by the unexpected tackiness of the solution resulting from the combination of citric acid with propylene glycol, while maintaining solution viscosity to a desirably low value. It is specifically the combination of the citric acid at a concentration of from 12 to 20%, to the propylene glycol at a selected concentration of 2 to 10%, that most desirably transforms the solution into a gummy and sticky compound.

Moreover, this cleaning compound does eliminate almost all surfactant and make the invention easier to biodegrade. Indeed, no surfactant needs to be present in the present cleaner formula, except the minimum of quaternary ammonium necessary to obtain the germicidal effect needed to disinfect the water cooler.

The invention also relates to a cleaning method for disinfecting and descaling a gravity-feed water dispenser with the above-noted cleansing compound, this water dispenser being of the type including a main frame having a top recess forming a water reservoir with a top open mouth, for receiving a water bottle atop in inverted position, water outlet faucets projecting outwardly from the main frame, and a water conduit network interconnecting the water reservoir to the faucets. The cleaning method includes the following steps:

a) removing the empty overhead water bottle;

b) partially emptying the water reservoir, while still leaving a small body of water at the bottom of the water reservoir, wherein the water conduit network remains submerged;

c) pour said cleaning compound onto the interior wall of the water reservoir, above water line of the remaining said body of water;

d) with a sponge, spreading the cleaning compound against the interior wall of the water reservoir and scrubbing same therealong;

e) leaving to stand the water dispenser for a period of time sufficient for the cleaning compound to reach out and penetrate the microbial and scale material;

f) open the faucets to release the body of water and cleaning compound dissolved therein;

g) unscrew the faucets and spray the cleaning compound into the water conduit network;

h) with a tubular brush, brush the water conduit network and faucets;

i) screw the faucets back into place and rinse with potable water; and j) install a filled up fresh water bottle, preliminary disinfected on his top surface with the cleaning compound.

It is noted that the method for cleaning a water dispenser in accordance with this invention, is simpler because some steps are done concurrently, in particular, the descaling and disinfecting operations are performed at the same time. In this new method the complete purging of the water at the bottom of the water basin inside the water dispenser, is not required at least during the initial steps of cleaning this water basin.

Indeed, the cleaning compound is allowed to mix with the remaining body of drinking water therein, since it is non toxic and biodegradable.

The present method allows the disinfectant, the descaler, and the deodorizer to all rapidly come in contact with all the component parts of the dispenser which come in contact with the drinking water.

This method prevents accidental recontamination by hands of the user and people who service and ship the bottled water, and is "foolproof".

It is noted that for effective water cooler dispenser disinfection, there needs to be proper cleaning action not only at the water basin level, but also at the canals and faucets parts thereof. Moreover, it is also noted that simple circulation of disinfectant and descaling through basin canals and faucets do not ensure full and efficient disinfection; there must be added the brushing of canals and faucets and the scrubbing of the basin interior with proper brushing and scrubbing tools, to ensure proper efficiency of descaling, disinfection and deodorizing of the water dispenser unit.

I claim:

1. A biodegradable, non toxic cleaning compound for use in cleaning hard surface components of water dispensers from microbial agents and scale material; said cleaning compound comprising the four following ingredients:

a) 0.08 to 0.1 weight percent of an ammonium quaternary;

b) 12 to 20 weight percent of organic acid, selected from the group consisting of: citric acid, gluconic acid and hydroxy acetic acid;

c) 2 to 10 weight percent of propylene glycol; and, d) a volume of alkaline water base.

2. A cleaning compound as defined in claim 1, wherein said ammonium quaternary is N'alkyl dimethyl Benzyl Ammonium Chloride.

3. A cleaning compound as defined in claim 2, wherein the amount by weight of N'alkyl dimethyl Benzyl Ammonium Chloride is within the range of 0.08 to 0.1% by weight of the total solution.

4. A cleaning compound as defined in claim 1, wherein the organic acid is citric acid.

5. A cleaning compound as defined in claim 1, wherein the range of organic acid is between 16 to 20% of the total solution.

6. A cleaning compound as defined in claim 5, wherein the concentration of organic acid is about 20%.

7. A cleaning compound as defined in claim 1, wherein the propylene glycol represents about 3 to 10% in weight of the total cleaning compound solution.

8. A cleaning compound as defined in claim 7, wherein the concentration of the propylene glycol is approximately 4% by weight of the total cleaning compound solution.

9. A cleaning compound as defined in claim 1, wherein the alkaline water base consists of sodium hydroxide.

10. A cleaning compound as defined in claim 1, wherein the alkaline water base is in sufficient quantity to neutralize the resulting solution to a pH range between to 2.6 and 4.5.

11. A biodegradable cleaning compound as in claim 3, wherein:

the organic acid is citric acid, at a concentration of about 20% in weight of the total solution;

the concentration of propylene glycol is about 4% by weight of the total solution; and, the alkaline water base consists of sodium hydroxide, in sufficient quantity to neutralize the total solution to a pH range between 2.6 and 4.5.

12. A cleaning method for disinfecting and descaling a gravity-feed water dispenser with a cleansing compound as defined in claim 1, the cleaning method includes the following steps:

a) removing an empty overhead water bottle;

b) partially emptying the water reservoir, while still leaving a small body of water at the bottom of the water reservoir, wherein the water conduit network remains submerged;

c) pour said cleaning compound onto the interior wall of the water reservoir, above water line of the remaining said body of water;

d) with a sponge, spreading the cleaning compound against the interior wall of the water reservoir and scrubbing same therealong;

e) leaving to stand the water dispenser for a period of time sufficient for the cleaning compound to reach out and penetrate the scale material and microbial agents rested therein;

f) open the faucets to release the body of water and cleaning compound dissolved therein;

g) unscrew the faucets and spray the cleaning compound into the water conduit network;

h) with a tubular brush, scrub the water conduit network and faucets;

i) screw the faucets back in place and rinse with potable water; and j) install a filled up fresh water bottle.

13. A cleaning method as in claim 12, wherein the water dispenser further has a water refrigerant system.

* * * * *